US006043795A

United States Patent [19]

Strieffler et al.

[11] Patent Number: 6,043,795

[45] Date of Patent: Mar. 28, 2000

[54] SUPPORT SYSTEM FOR LARGE ANTENNAS, INCLUDING MULTI-BEAM ANTENNAS

[75] Inventors: Steven J. Strieffler, Freehold, N.J.; Anthony F. Szamboti, Penndel, Pa.

[73] Assignee: Radio Frequency Systems, Inc., Marlboro, N.J.

[21] Appl. No.: 09/165,914

[22] Filed: Oct. 2, 1998

[51] Int. Cl.[7] ..... H01Q 1/12

[52] U.S. Cl. ..... 343/890; 343/880; 343/892; 52/40

[58] Field of Search ..... 343/878, 880, 343/882, 890, 891, 892, DIG. 2; 248/201, 237, 323; 52/40, 114; H01Q 1/12, 21/00

[56] References Cited

U.S. PATENT DOCUMENTS

| | | | |
|---|---|---|---|
| D. 380,474 | 7/1997 | Pietrangelo et al. | D14/231 |
| D. 387,064 | 12/1997 | Heine | D14/238 |
| 2,618,746 | 11/1952 | Pauch | 343/890 |
| 4,755,830 | 7/1988 | Plunk | 343/890 |
| 5,533,304 | 7/1996 | Noble | 52/40 |
| 5,596,334 | 1/1997 | Boyce et al. | 343/702 |
| 5,604,508 | 2/1997 | Atkinson | 343/879 |
| 5,611,176 | 3/1997 | Juengert et al. | 52/40 |
| 5,633,647 | 5/1997 | Tines | 343/766 |
| 5,647,567 | 7/1997 | Pugh, Jr. et al. | 248/237 |
| 5,649,402 | 7/1997 | Moore | 52/651.02 |
| 5,684,493 | 11/1997 | Floyd et al. | 343/709 |
| 5,714,963 | 2/1998 | Cox | 343/786 |
| 5,787,673 | 8/1998 | Noble | 52/726.1 |
| 5,943,024 | 8/1999 | Lydon | 343/781 R |

*Primary Examiner*—Don Wong
*Assistant Examiner*—Tho Phan
*Attorney, Agent, or Firm*—Ware, Fressola, Van Der Sluys & Adolphson LLP

[57] ABSTRACT

A support system for an antenna having a pair of support arms (2) each secured at one end to a clamp (1) and having slots (3) formed at the other end to secure a support lug (4). The support lug has a first end (5) to receive a clamping mechanism (6) for securing the lug to a support pipe or column, and a second end (7) having at least three apertures (8,9) for attaching the lug to the support arms by means of fasteners (10). The slots in the support arms and support lug allow the support system to be secured to support pipes having a wide range of diameters by allowing each support arm to be secured to the support lug while forming any one of a range of angles therewith and while not requiring removal of the fastening bolts. In addition, each of the support arms can be secured to a hinge (11) pivoting with the antenna, allowing the support arms to secure the support lug which preferably stays perpendicular with respect to the support pipe while the antenna can be titled about an axis perpendicular to the support pipe.

12 Claims, 7 Drawing Sheets

SUPPORT SYSTEM FOR LARGE ANTENNAS, INCLUDING MULTI-BEAM ANTENNAS

FIELD OF THE INVENTION

The present invention relates to antenna support structures and, more specifically, to antenna support structures which are secured to a support pipe or column.

BACKGROUND OF THE INVENTION

Presently, large antennas, including multi-beam antennas are secured to a support pipe or column by means of brackets, spokes or threaded rods. The bracket is usually attached to the support pipe with a pair of clamping brackets as described in Moore (U.S. Pat. No. 5,649,402), or with mounting brackets with associated U-bolts and nuts as shown in FIG. 1. The disadvantages of these mounting devices are that they do not allow for variances in antenna size and, in general, they can only fit a support pipe of a certain size. For that reason, brackets are usually designed to be used on antennas of a certain size and shape.

It is advantageous to provide a support system which accommodates various pipe sizes, along with various antenna widths.

SUMMARY OF THE INVENTION

It is an objective of the present invention to provide an antenna support system which can be used on antennas of different widths.

It is another objective of the present invention to provide an antenna support system which can be used to secure antennas to support pipes of different sizes.

It is yet another objective of the present invention to provide an antenna support system which produces a counteracting moment to balance the moment placed on the clamping mechanism by the wind.

The foregoing objectives can be achieved by using a pair of support arms each having one or more slots to attach a support lug and by securing the support arms near the edge of an antenna. In the support system in accordance with the present invention, the support arms are secured to the antenna by anchoring means such as angle clamps or hinges. These angle clamps or hinges are secured to the antenna at two locations preferably maximally separated from each other along a transverse distance perpendicular with respect to the axial length of the support pipe. This allows the support arms to extend to nearly the edge of the antenna. The support lug, along with clamping means, is used to secure the antenna to a support pipe. The support lug has a number of apertures, which match the slots on the support arms, to receive fasteners. The slots on the support arms and the apertures on the support lug allow the antenna to be secured to a support pipe having any one of a wide range of permissible diameters. At the same time, these slots and apertures allow the support system to be used on antennas of different widths since the slots in the support arms are able to align with the apertures in the support lug even though the support arms form different angles with the support lug for different diameter support pipes. In addition, the fact that the support arms extend to near the edge of the antenna provides a counteracting moment to balance the moment placed on the clamping means by the wind. This counteracting moment is important in securing an antenna in an area having a large wind-loading.

The objectives and advantages of the present invention will be apparent from the following detailed description taken in conjunction with the accompanying drawings.

BRIEF DESCRIPTION OF THE DRAWINGS

In the following, the invention and its advantages will be represented in conjunction with an exemplary embodiment with the aid of the drawings.

DETAILED DESCRIPTION OF THE PREFERRED EMBODIMENTS

Figure 1:
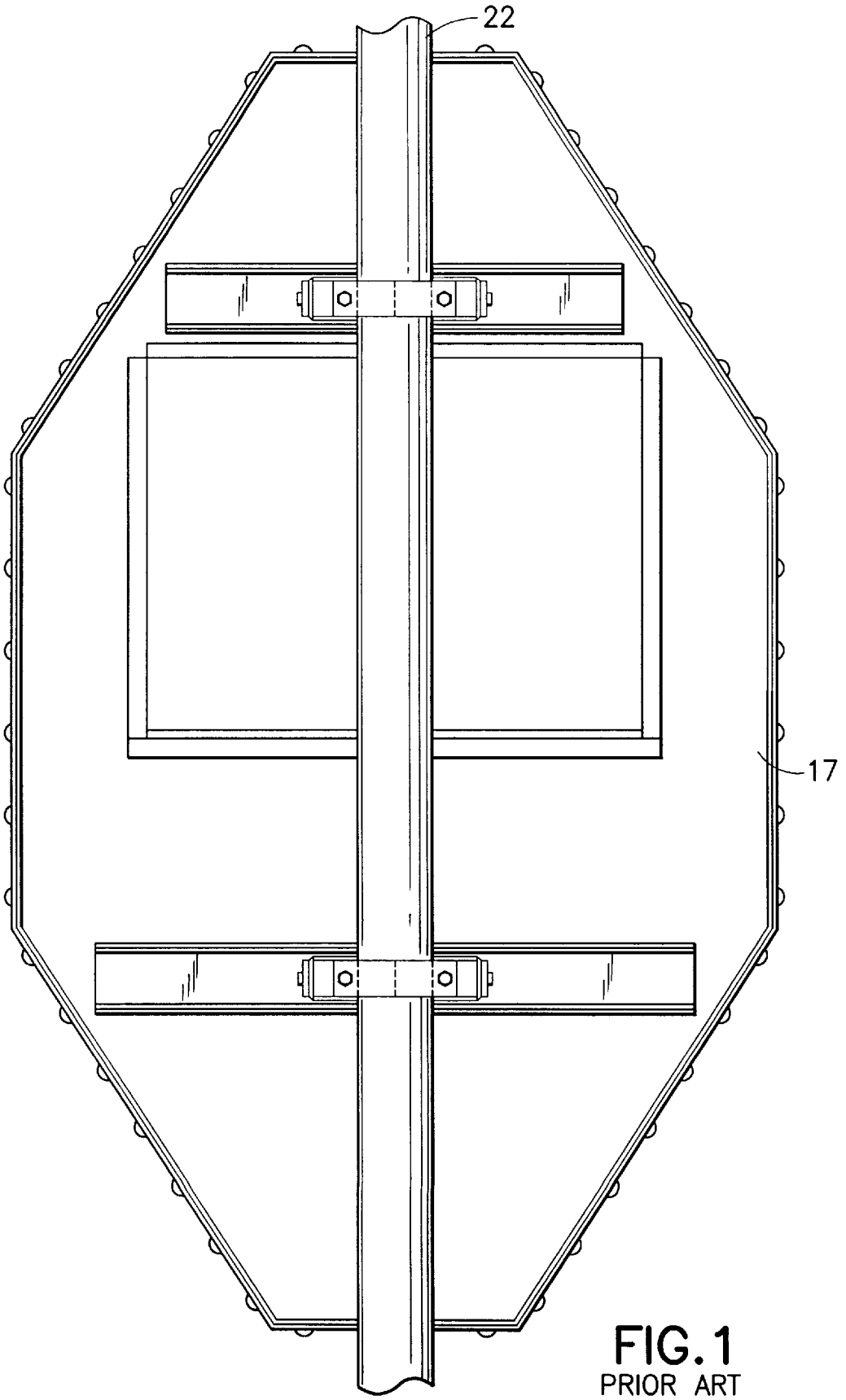
FIG. 1 PRIOR ART
FIG. 1 illustrates one of the conventional methods for securing an antenna to a support pipe. As shown, two U-bolts are used to secure an antenna 17 to a support pipe 22.
Figure 2:
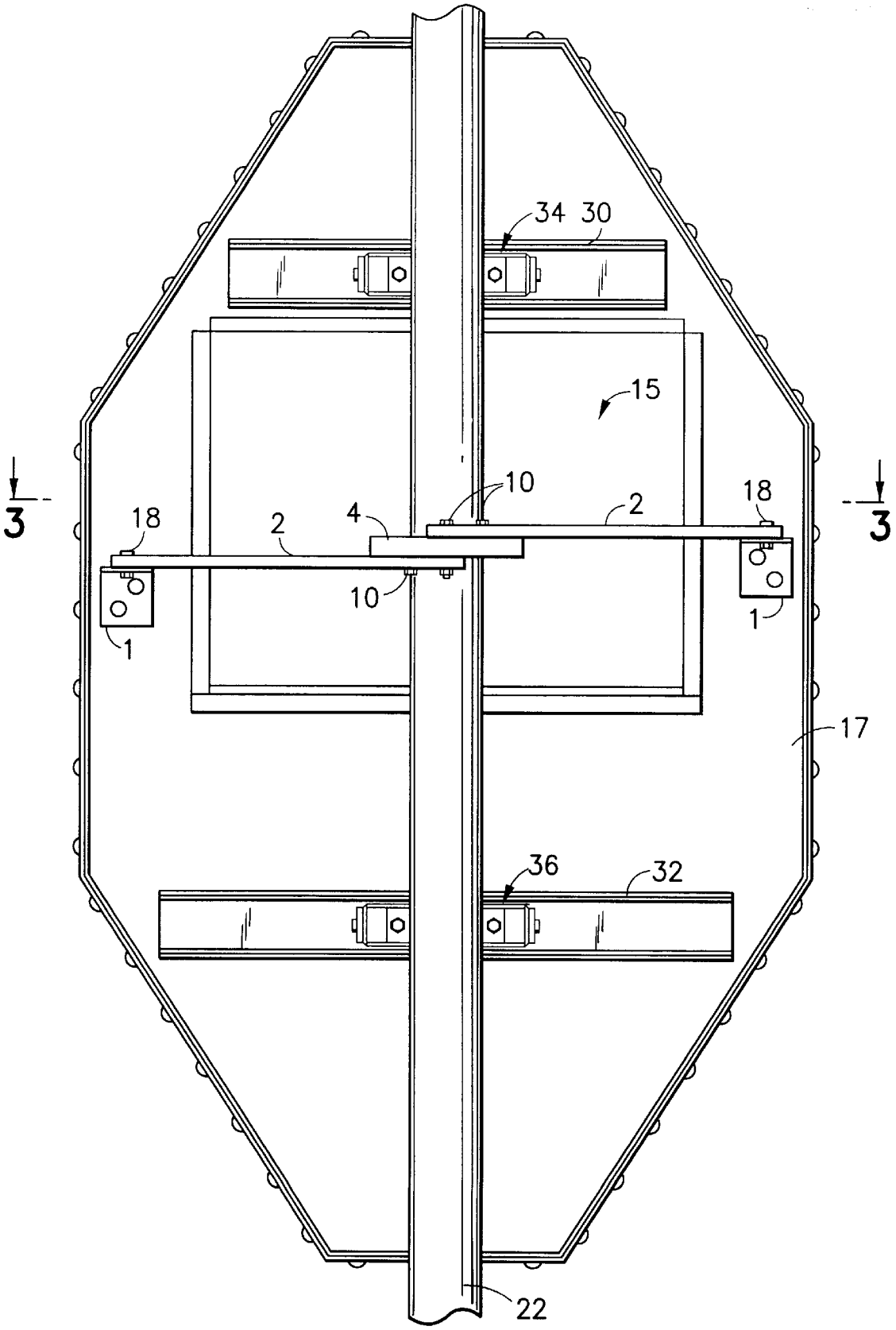
FIG. 2 is the rear view of an antenna having a support system in accordance with the present invention, for securing the antenna to a support pipe.
Figure 3:
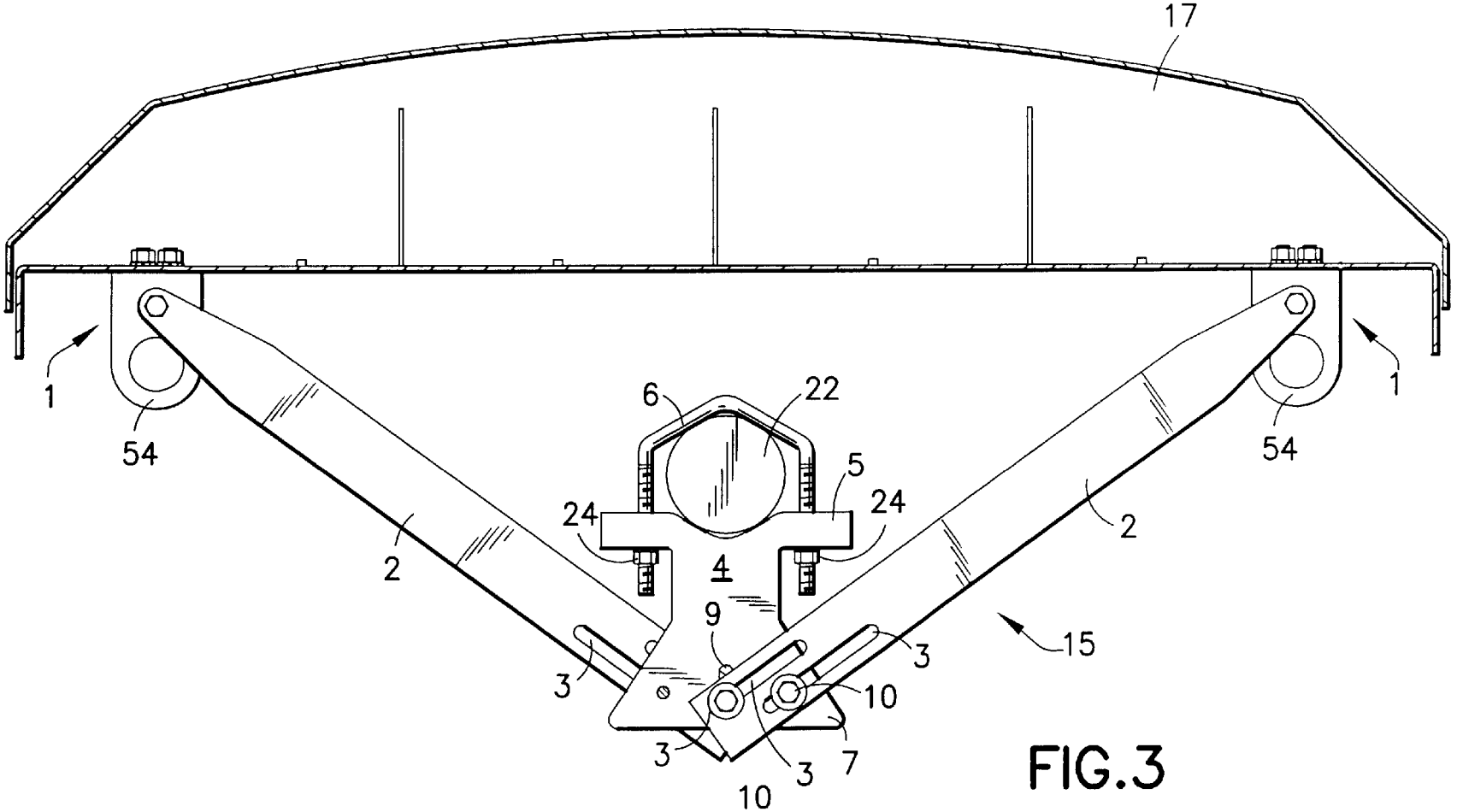
FIG. 3 is a top view of the antenna and the support system generally along lines 3—3 of FIG. 2.

An antenna support system in accordance with the preferred embodiment of the present invention is shown generally at 15 in FIG. 2 and FIG. 3. As shown in FIG. 2, the support system 15 is secured to the back of an antenna 17 with a pair of angle clamps 1. A pair of support arms 2 are secured to respective angle clamps 1 by fastening means 18. A support lug 4 is attached to the support arms by fasteners 10. As can be seen in FIG. 3, the support lug is secured to a support pipe 22 by a clamp 6 and associated nuts 24.

Figure 3A:
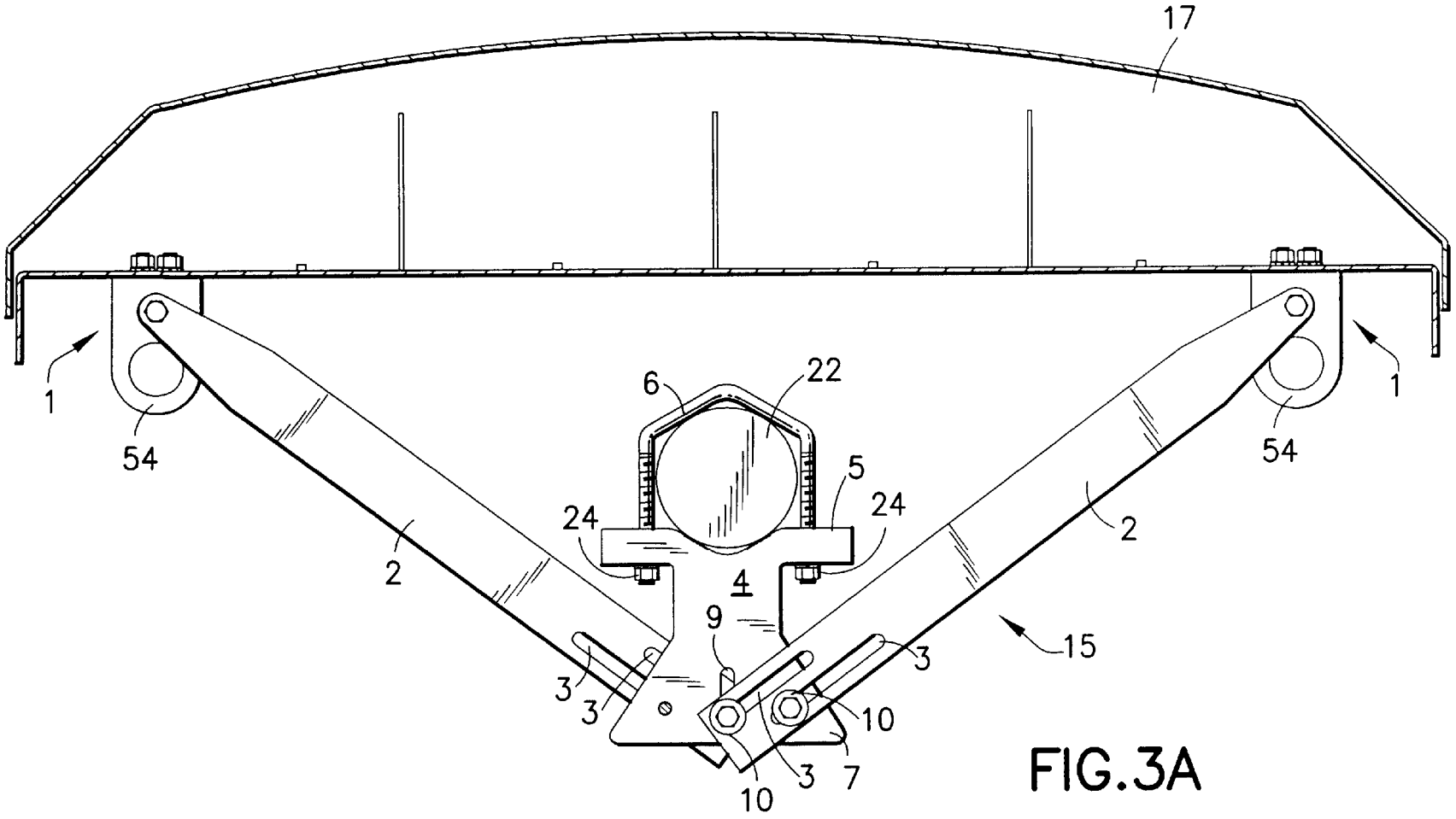
FIG. 3A is a top view of the antenna similar to FIG. 3 showing the support system attached to a larger diameter support pipe than the support pipe shown in FIG. 3.
Figure 4A:
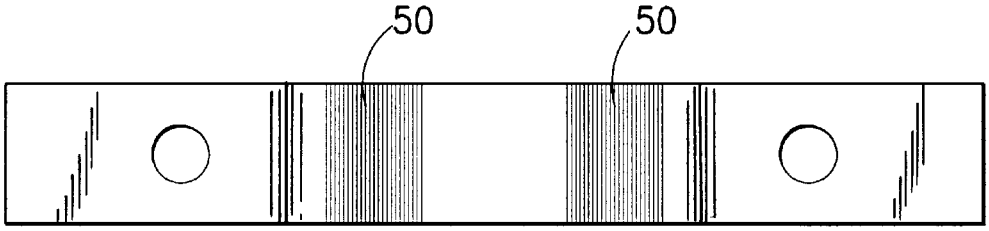
FIG. 4A is an edge view of the support lug that makes contact with the support pipe.

FIG. 3 is a top view of the antenna with the support system taken along lines 3—3 of FIG. 2. FIG. 3 clearly shows that the support arms extend to near the edge of the antenna. On each of the support arms 2, two slots 3 are provided to secure the support lug 4 by means of fasteners 10. As seen in FIGS. 3, 3A, 4 and 4A the support lug has a first end 5 for receiving the clamp 6. FIG. 4A shows striations 50 formed in the support lug to insure a secure attachment of the support lug to the support pipe. Due to the generally curved region 52 of this end of the support lug, secure attachment to support pipes of various diameters is easily accommodated. This feature is clearly seen in FIG. 3A where the support system is attached to support pipe 22' having a significantly larger diameter than the support pipe 22 shown in FIG. 3.

The second end 7 of the support lug has three apertures 8 and 9 to receive fasteners 10. One of the apertures is a slot 9 which is partially shown in FIG. 3 while apertures 8 are preferably threaded holes. As can be seen in FIGS. 3 and 3A, the support arms can be further pushed outward from the rear of the antenna, if necessary. With the slots 3 on the support arms and the slot 9 on the support lug, the support system can accommodate a larger diameter support pipe 22' as seen in FIG. 3A than the one shown in FIG. 3. When the support system is secured to a smaller pipe, the support arms can be pushed closer to the back of the antenna. Thus rotation of the output arms to accommodate different diameter support pipes 22, 22' is accomplished without removal of the support arms from the support lug.

In order to prevent swaying of the antenna relative to support pipe 22, upper and lower mounting brackets 30, 32 and associated mounting hardware 34, 36 are used. The mounting hardware can be conventional U-bolt-shaped brackets. Because the antenna support system 15 is securely fastened to the support pipe, this mounting hardware 34, 36 need only be of sufficient size to resist antenna movement due to wind loading, rather than also being primarily responsible for supporting the weight of antenna 17.

It should be noted that FIGS. 3 and 3A illustrate that clamps 1 each include apertured extending ends 54 that allow the antenna to be lifted by a crane or the like.

Figure 4:
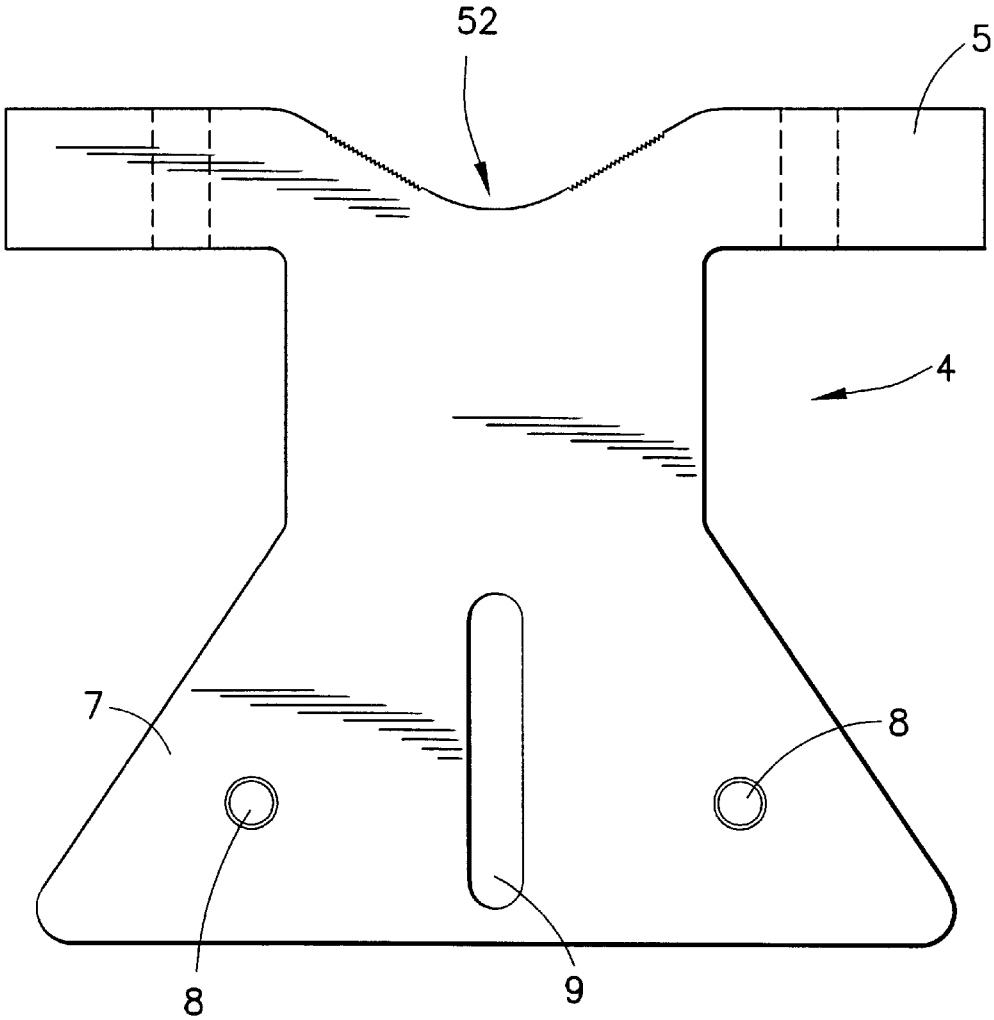
FIG. 4 is a plan view of the support lug.

FIGS. 4 and 4A show the details of the support lug. As shown, the support lug 4 has three apertures 8 and 9 on the end 7 of the lug. The apertures 8 are preferably threaded holes for directly anchoring bolts. The aperture 9 is a slot which allows the support arms to be pushed in or out to accommodate an antenna having a different width or a support pipe having a different diameter. It should be noted that the apertures 8 could also be made in the form of through holes or slots.

Figure 5A:
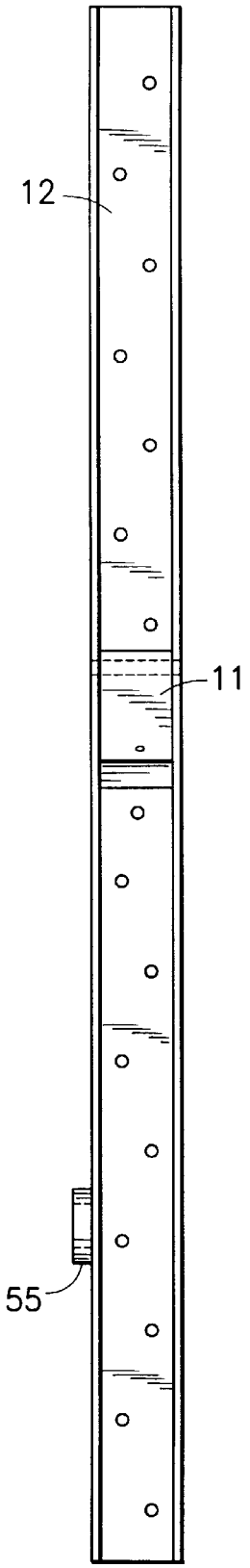
FIG. 5A is a plan view of a rail having a hinge for securing a support arm.
Figure 5B:
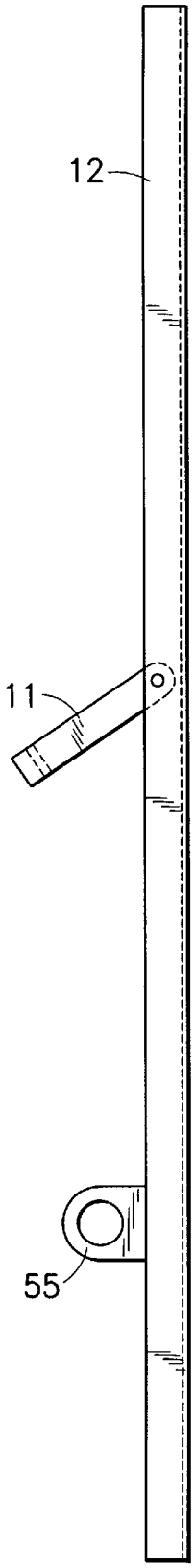
FIG. 5B is a side view of the rail.

FIG. 5A and FIG. 5B illustrate another embodiment of the present invention. FIG. 5A and FIG. 5B show different views of a rail 12 having a hinge 11. The hinge 11 is pivotally mounted on the rail. Thus, when the rail is secured to an antenna, the hinge pivots with the antenna. The hinge is used to secure a support arm 2, as shown in FIG. 6A. Lifting members 55 facilitate lifting the antenna by a crane or the like.

FIG. 6A is the rear view of an antenna having a support system for securing the antenna to a support pipe while allowing the antenna to be tilted with respect to the support pipe. As shown in FIG. 6A, each of the support arms 2 is secured to a hinge 11 which is mounted on a rail 12.

Figure 6B:
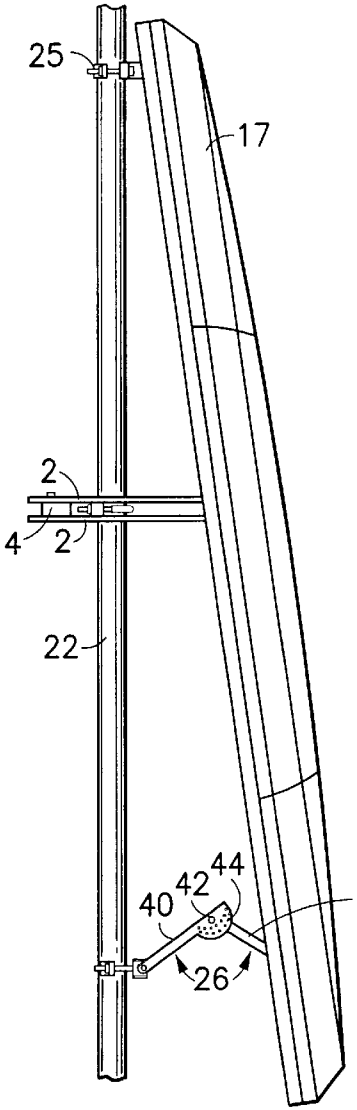
FIG. 6B illustrates the antenna being secured to the support pipe in a tilted position.
Figure 6A:
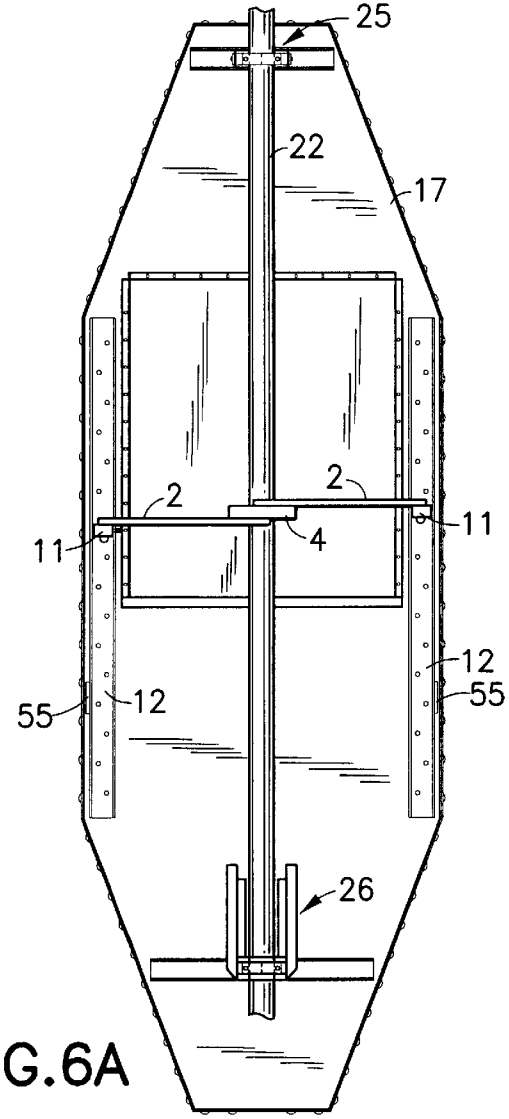
FIG. 6A is the rear view of an antenna having a support system for securing the antenna to a support pipe while allowing the antenna to be tilted with respect to the axis of the support pipe.

FIG. 6B illustrates an antenna being secured to a support pipe in a tilted position. As the hinges pivot with respect to the antenna, they allow support arms 2 to secure the support lug 4 so that the plane defined by the support arms preferably stays perpendicular with respect to the support pipe 22. As can be seen in FIG. 6B, even when the antenna is mounted in a tilted position, the support arms and the lug thus remains perpendicular to the support pipe. In order to keep the antenna in a certain tilted position, additional fastening means 25, 26 may be used to attach the antenna to the support pipe. Fastening means 25 can be a contentional U-bolt and nuts while fastening means 26 has a first arm 40 with a pivot hole 42 and a plurality of holes 44 positioned at different angular locations with respect to pivot hole 42. A second arm 46 is attached at one end to antenna 17 and is secured to arm 40 via mounting to pivot hole 42 and to one of the peripheral holes 44. The other end of arm 40 is attached to support pipe 22 by conventional means, such as a U-bolt fastener.

The present invention has been described in accordance with particular embodiments. Obviously, many modifications and variations of the present invention may become apparent in light of the above teachings. For example, the number of slots on each of the support arms can be smaller or greater than two. Accordingly, the number of apertures on the support lug can be smaller or greater than three. Furthermore, many different types and shapes of the clamping mechanism can be used to secure a support lug to a support pipe.

In light of the above, it is therefore understood by those skilled in the art that within the scope of the appended claims, the invention may be practiced otherwise than as specifically described.

What is claimed is:

1. A support system for an antenna so as to secure the antenna to a support pipe comprising:

support arms (2) each pivotally fastenable at a first end thereof to the antenna at respective locations preferably separated from each other along a traverse distance perpendicular with respect to the axial length of the support pipe, each support arm having at least one slot (3) formed thereon at a second end; and at least one support lug (4) having a first end (5) to receive clamping means (6, 24) for securing the lug to the support pipe, and a second end (7) having at least three apertures (8,9) formed therein for securing the support arms to the lug by means of fasteners (10) so as to allow the support system to accommodate a support pipe having any one of a range of different diameters by allowing each support arm to be secured to the support lug while forming any one of a range of angles therewith.

2. The support system of claim 1 wherein each support arm is pivotally fastenable to the antenna by means of a clamp (1) to which the support arm is pivotally attached, each clamp in turn is securable to the antenna.

3. The support system of claim 1 wherein each of said support arms (2) has at least two slots (3) formed thereon at the second end.

4. The support system of claim 1 wherein said support lug apertures (8, 9) are two holes (8) with a slot (9) positioned between the two holes and further having striations (50) formed at the first end to facilitate secure attachment of the support lug to the support pipe (22).

5. The support system of claim 4 wherein said apertures (8, 9) in the support lug comprise two threaded holes (8) for receipt of anchoring bolt fasteners (10) and one slot (9) for receiving at least one fastener (10).

6. The support system of claim 5 wherein said apertures (8, 9) in the support lug comprise two through holes (8) and one slot (9) for receiving fasteners (10).

7. A support system for an antenna so as to secure the antenna to a support pipe comprising:

attachment means (11) securable to the antenna at respective locations preferably separated from each other along a traverse distance perpendicular with respect to the axial length of the support pipe, support arms (2) each pivotally fastenable at a first end thereof to the attachment means, each support arm having at least one slot (3) formed thereon at a second end; and at least one support lug (4) having a first end (5) to receive clamping means (6, 24) for securing the lug to the support pipe, and a second end (7) having at least three apertures (8,9) formed therein for securing the support arms to the lug by means of fasteners (10) so as to allow the support system to accommodate a support pipe having any one of a range of different diameters by allowing each support arm to be secured to the support lug while forming any one of a range of angles therewith;

wherein the attachment means (11) pivot with respect to the antenna, thereby allowing the support arms to attach to the support lug so as to preferably be positioned perpendicular with respect to the support pipe.

8. The support system of claim 7 wherein the attachment means are hinges (11) to which the support arm is pivotally attached, each hinge in turn is securable to the antenna.

9. The support system of claim 8 wherein each of the hinges (11) is pivotally attached to a rail (12) fastened to the antenna.

10. The support system of claim 7 further comprising fastening means (25, 26) to attach the antenna to the support pipe for keeping the antenna in a certain tilted position with respect to the support pipe.

11. The support system of claim 7 wherein each of said support arms (2) has at least two slots (3) formed thereon at the second end.

12. The support system of claim 7 wherein said support lug (4) has at least three apertures (8,9) formed on the second end (7) for securing the support arms to the lug and further having striations formed at the first end to facilitate secure attachment of the support lug to the support pipe.

* * * * *